US010435652B2

(12) United States Patent
Nakanishi et al.

(10) Patent No.: US 10,435,652 B2
(45) Date of Patent: Oct. 8, 2019

(54) LIQUID LAUNDRY DETERGENT COMPOSITION FOR CLOTHING

(71) Applicant: LONZA LTD, Visp (CH)

(72) Inventors: Mutsumi Nakanishi, Chiba (JP); Kazuhiko Sakata, Chiba (JP)

(73) Assignee: LONZA LTD., Visp (CH)

( * ) Notice: Subject to any disclaimer, the term of this patent is extended or adjusted under 35 U.S.C. 154(b) by 0 days.

(21) Appl. No.: 15/117,838

(22) PCT Filed: Feb. 6, 2015

(86) PCT No.: PCT/JP2015/053333
§ 371 (c)(1),
(2) Date: Aug. 10, 2016

(87) PCT Pub. No.: WO2015/122360
PCT Pub. Date: Aug. 20, 2015

(65) Prior Publication Data

US 2016/0355761 A1 Dec. 8, 2016

(30) Foreign Application Priority Data

Feb. 14, 2014 (JP) ..... 2014-026197

(51) Int. Cl.
*C11D 3/48* (2006.01)
*C11D 3/37* (2006.01)

(52) U.S. Cl.
CPC ..... *C11D 3/48* (2013.01); *C11D 3/3723* (2013.01); *C11D 3/3769* (2013.01); *C11D 3/3773* (2013.01)

(58) Field of Classification Search
CPC ..... C11D 3/48; C11D 3/3769
See application file for complete search history.

(56) References Cited

U.S. PATENT DOCUMENTS

| | | | | |
|---|---|---|---|---|
| 6,680,289 | B1 * | 1/2004 | Woo | A61L 9/01 510/101 |
| 7,012,053 | B1 * | 3/2006 | Barnabas | C11D 3/221 510/101 |
| 2002/0010106 | A1 * | 1/2002 | Uchiyama | C11D 3/222 510/101 |
| 2002/0014178 | A1 * | 2/2002 | Haught | A01N 37/40 106/15.05 |
| 2005/0003978 | A1 * | 1/2005 | Hall | C09D 5/086 510/175 |
| 2009/0022812 | A1 * | 1/2009 | Maki | C11D 3/0047 424/616 |
| 2012/0172404 | A1 * | 7/2012 | Beilfuss | A01N 33/04 514/373 |
| 2012/0189603 | A1 * | 7/2012 | Beilfuss | A01N 33/04 424/94.4 |
| 2016/0355761 | A1 * | 12/2016 | Nakanishi | C11D 3/48 |

FOREIGN PATENT DOCUMENTS

| | | | | |
|---|---|---|---|---|
| EP | 2443928 | A1 * | 4/2012 | A01N 43/56 |
| EP | 3106507 | A1 * | 12/2016 | |
| EP | 3461334 | A1 | 4/2019 | |
| JP | S62172007 | A | 7/1987 | |
| JP | S63-162799 | A | 7/1988 | |
| JP | H05139918 | A | 6/1993 | |
| JP | H07187936 | A | 7/1995 | |
| JP | 2001010905 | A | 1/2001 | |
| JP | 2002-60787 | A | 2/2002 | |
| JP | 2002-060788 | A | 2/2002 | |
| JP | 2002060788 | A * | 2/2002 | |
| JP | 2006-160822 | A | 6/2006 | |
| JP | 2006-169515 | A | 6/2006 | |
| JP | 2007-246839 | A | 9/2007 | |
| JP | 2007246839 | A * | 9/2007 | |
| JP | 2009-073915 | A | 4/2009 | |

(Continued)

OTHER PUBLICATIONS

JP 2002 060788 A. A Translation.*
European Commission report on Biocidal activity of Didecyldimethylammonium Carbonate / Bicarbonate (DDA Carbonate) (Jul. 2012).*
Lonza Product report on didecylmethylpolyoxyethyleneammonium propionate (Mar. 2003).*
EP 2443928. English Translation.*
International Search Report, PCT/JP2015/05333, dated Apr. 21, 2015.
Written Opinion by the ISA, PCT/JP2015/05333, dated Apr. 21, 2015.

(Continued)

*Primary Examiner* — Nicole M. Buie-Hatcher
*Assistant Examiner* — M. Reza Asdjodi
(74) *Attorney, Agent, or Firm* — Hoffmann & Baron, LLP

(57) ABSTRACT

[Problem to be Solved] To provide a liquid laundry detergent composition for clothing which can remove bacteria from the clothing effectively during washing and also impart an excellent antibacterial effect to the clothing after washing.

[Solution] A liquid laundry detergent composition for clothing comprising: a bacteria-eliminating active agent, at least one cationic polymer selected from the following components (a), (b) and (c), and a surfactant: the component (a): diallylamine hydrochloride polymers, diallylamine polymers, methylallylamine hydrochloride polymers, diallyldimethylammonium chloride polymers, diallylmethylethyl sulfate polymers, diallylamine hydrochloride-sulfur dioxide copolymers, diallylamine acetate-sulfur dioxide copolymers and the like; the component (b) acrylamide-diallylamine hydrochloride copolymers, acrylamide-diallyldimethylammonium chloride copolymers and the like; the component (c) allylamine hydrochloride polymers, allylamine polymers, allylamine hydrochloride-diallylamine hydrochloride copolymers, allylamine acetate-diallylamine acetate copolymers and the like.

4 Claims, No Drawings

(56) References Cited

FOREIGN PATENT DOCUMENTS

| | | | |
|---|---|---|---|
| JP | 2009-263812 | A | 11/2009 |
| JP | 2010-184987 | A | 8/2010 |
| JP | 2010-275213 | A | 12/2010 |
| JP | 2011-037945 | A | 2/2011 |
| JP | 2011-137112 | A | 7/2011 |
| JP | 2011-190368 | A | 9/2011 |
| JP | 2012091409 | A1 | 5/2012 |
| JP | 2014500887 | A | 1/2014 |
| JP | 2014-028942 | A | 2/2014 |
| WO | 2008110590 | A1 | 9/2008 |
| WO | WO2011/152452 | A1 | 12/2011 |
| WO | 2013098547 | A1 | 7/2013 |
| WO | 2013124784 | A1 | 8/2013 |

OTHER PUBLICATIONS

"Production Technology of Functional Plastic Masterbatch", edited by GE Hongtao, etc., China Light Industry Press, published on Jun. 2006, p. 113.

* cited by examiner

LIQUID LAUNDRY DETERGENT COMPOSITION FOR CLOTHING

This application is the U.S. National Phase of, and Applicants claim priority from, International Patent Application Number PCT/JP2015/053333 filed Feb. 6, 2015, which claims priority from JP 2014/026197 filed Feb. 14, 2014, each of which is incorporated herein by reference.

TECHNICAL FIELD

The present invention relates to liquid laundry detergent compositions for clothing which can effectively disinfect clothes during washing and also impart an excellent antibacterial effect to the clothes after washing.

BACKGROUND ART

Conventionally, methods of imparting bactericidal effects and antibacterial effects to the laundry during washing have been known. Patent Literatures 1 to 9 describe a method of adding hydrogen peroxide or a compound which generates hydrogen peroxide in water to a liquid laundry detergent composition for clothing, a method of using bleaching activator(s) together with the composition, and a method of adding antibacterially active cationic agent(s) such as quaternary ammonium salts and polyaminopropyl biguanide salts or antibacterially active inorganic agent(s) such as water-soluble silver.

However, in the case of a liquid laundry detergent composition for clothing containing hydrogen peroxide or a compound which generates hydrogen peroxide in water, it has less long-term stability and cannot be expected to exhibit bactericidal effects and antibacterial effects over a long period of time.

In the case of a liquid laundry detergent for clothing containing antibacterially active cationic agent(s) such as quaternary ammonium salts and polyaminopropyl biguanide salts, the active agents are immediately adsorbed into the coexisting laundry during washing and cannot attack the bacteria lurking in the water between the fibers. They cannot sufficiently exhibit bactericidal effects, accordingly. Furthermore, the capacity of washing machines has recently increased, and a lot of laundry is more often packed into a washing machine to wash together. When the laundry packed into the washing machine is washed, antibacterially active cationic agents cannot sufficiently reach the inside of the fibers, and cannot be expected to exhibit bactericidal effects and antibacterial effects at all. Furthermore, some antibacterially active cationic agents may react with chlorine in tap water, which deteriorates the antibacterial activity of the agents or may yellow white cotton fibers. In the case of a liquid laundry detergent composition for clothing containing water-soluble silver, it has a problem of poor stability.

In recent years, considering the influence on the environment, use of the hot water left in the tub after taking a bath to do the laundry has tended to increase, and it has been confirmed that not less than 60% of households use the hot water left in the tub after taking a bath to do the laundry throughout a year. This is because that in addition to the advantage of saving water, washing at a higher temperature improves cleaning efficiency. However, the hot water left in the tub after taking a bath comprises a lot of microorganisms and dirt from human bodies and the environment, and the number of bacteria in the water kept overnight from bathing reaches as many as $10^6$ to $10^7$/ml. Therefore, use of the hot water left in the tub after taking a bath as water to do laundry also causes an increased number of bacteria in the laundry. For this reason there is need for a technology exhibiting a higher bactericidal effect which can reduce the number of bacteria in the reaming hot water and the number of bacteria attached to the laundry in a short period of time to do the laundry with the hot water in the tub after taking a bath.

Further, in the case of room-drying the laundry, which follows washing with the hot water left in the tub after taking a bath, thereby the laundry being kept under a high humidity condition for a long period of time, which is a suitable environment for the growth of residual bacteria, it is a cause of unpleasant damp-dry odor, also called room dry smell. Therefore, in order to suppress the growth of bacteria in the clothing after washing, there is need for a technique of imparting a higher antimicrobial effect than conventional ones.

Patent Literatures 9 and 10 disclose that liquid laundry detergent compositions for clothing containing a quaternary nitrogen-containing polymer prevents a damp-dry odor of the clothing caused by room-drying, and imparts a dirt release effect. However, they do not describe at all that the compositions impart the bactericidal effect during washing.

The term "bactericidal" herein means eliminating, through bactericidal activities, bacteria which have already attached to the laundry and grown prior to washing. The term also means reducing the number of bacteria in the laundry during doing the laundry with the hot water left in the tub after taking a bath. The term "antibacterial" means that the active ingredient which remains on the laundry exhibits the activities to inhibit the proliferation of bacteria.

CITATION LIST

Patent Literatures

[Patent Literature 1] Japanese Patent Publication No. 2006-169515

[Patent Literature 2] Japanese Patent Publication No. 2006-160822

[Patent Literature 3] Japanese Patent Publication No. 2009-73915

[Patent Literature 4] Japanese Patent Publication No. 2009-263812

[Patent Literature 5] Japanese Patent Publication No. 2010-275213

[Patent Literature 6] Japanese Patent Publication No. 2010-184987

[Patent Literature 7] Japanese Patent Publication No. 2011-37945

[Patent Literature 8] Japanese Patent Publication No. 2011-137112

[Patent Literature 9] Japanese Patent Publication No. 2002-60787

[Patent Literature 10] Japanese Patent Publication No. 2007-246839

SUMMARY OF INVENTION

Technical Problem

Therefore, there are required liquid laundry detergent compositions for clothing which can effectively remove bacteria during washing and also impart an excellent antibacterial effect to the clothing after washing.

Solution to Problem

The present invention has been made in view of the circumstances described herein above, and provides

[1] A liquid laundry detergent composition for clothing characterized by comprising:

a bacteria-eliminating active agent, at least one cationic polymer(s), and a surfactant;

wherein the at least one cationic polymer is selected from the following components (a), (b) and (c):

component (a): a polymer having a constitutional unit selected from formulas 1, 2, 3, 4 and salts thereof;

component (b): a copolymer having a constitutional unit selected from formula 5 and salts thereof and a constitutional unit selected from formulas 1, 2, 3, 4 and salts thereof; and component (c): a polymer having a constitutional unit selected from formula 6 and salts thereof, or a copolymer having a constitutional unit selected from formula 6 and salts thereof and a constitutional unit selected from formulas 1, 2, 3, 4 and salts thereof:

Formula 1

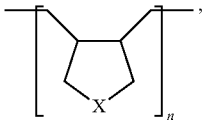

Formula 2

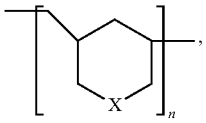

Formula 3

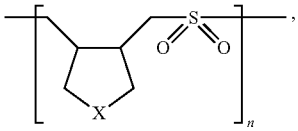

Formula 4

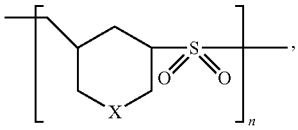

Formula 5

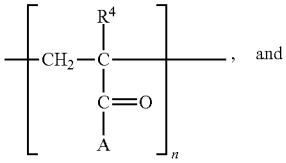

Formula 6

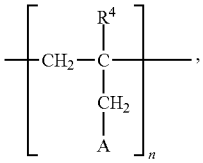

wherein X represents a group selected from:

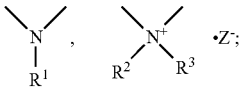

$R^1$ represents a hydrogen atom, an alkyl group having 1 to 3 carbon atoms or a hydroxyl group;

$R^2$ and $R^3$ independently represent an alkyl or hydroxyl alkyl group having 1 to 3 carbon atoms;

$Z^-$ represents a halogen ion, a sulfate ion, an alkyl sulfate ester ion having 1 to 3 carbon atoms, an aromatic sulfonate ion or a hydroxyl ion;

$R^4$ represents a hydrogen atom or an alkyl group having 1 to 3 carbon atoms;

A represents $—NH_2$, —OM, $—OR^5$ or $—NR^6R^7$;

M represents a monovalent cation;

$R^5$ represents an alkyl group having 1 to 24 carbon atoms;

$R^6$ and $R^7$ independently represent an alkyl or hydroxyl alkyl group having 1 to 3 carbon atoms; and n is an integer between 1 and 3,000.

The present invention further may comprise the following:

[2] the liquid laundry detergent composition for clothing according to [1], characterized in that the bacteria-eliminating active agent is at least one selected from quaternary ammonium salts, polyaminopropyl guanidine compounds, imidazolium salt derivatives, and bis(aminoalkyl) alkylamines;

[3] the liquid laundry detergent composition for clothing according to [1], characterized in that the bacteria-eliminating active agent includes at least one bactericidal agent selected from quaternary ammonium salt non-halides, polyaminopropyl guanidine hydrochlorides; imidazolium salt derivatives selected from 1,10-di(3-decyl-2-methylimidazolium)decane dichloride, 1,10-di(3-decyl-2-methylimidazolium)decane dibromide, 1,12-di(3-decyl-2-methylimidazolium)dodecane dichloride and 1,12-di(3-octyl-2-methylimidazolium)dodecane dichloride; and bis(aminopropyl)dodecylamine; and

[4] the liquid laundry detergent composition for clothing according to [1], characterized by comprising:

the bacteria-eliminating active agent in an amount between 0.1% by weight and 20% by weight, at least one cationic polymer selected from the components (a), (b) and (c) in an amount between 0.1% by weight and 20% by weight, and a surfactant in an amount between 5% by weight and 90% by weight.

Effect of Invention

According to the present invention, there is provided a liquid laundry detergent composition for clothing which can effectively remove bacteria during washing and impart an excellent antimicrobiral effect to the clothing after washing.

DESCRIPTION OF INVENTION

The present invention will hereinafter be described in detail.

A liquid laundry detergent composition for clothing according to the present invention is characterized by comprising a bacteria-eliminating active agent, at least one cationic polymer selected from the components (a), (b) and (c), and the surfactant.

The bacteria-eliminating active agent used according to the present invention is in general referred to as a bactericidal agent and includes, for example, quaternary ammonium salts such as benzalkonium chloride, didecyldimethylammonium chloride, didecylmethylpolyoxyethyleneammonium propionate, didecylmethylammonium carbonate, or benzethonium chloride; imidazolium derivatives such as 1,10-di(3-decyl-2-methylimidazolium)decane dichloride, 1,10-di(3-decyl-2-methylimidazolium)decane dibromide, 1,12-di(3-decyl-2-methylimidazolium)dodecane dichloride, 1,12-di(3-octyl-2-methylimidazolium)dodecane dichloride, or 1,10-di(3-decyl-2-methylimidazolium)decane dichloride; biganide compounds such as polyaminopropyl biganide (PHMB); guanidine compounds such as ethoxyethylguanidine chloride and polyaminopropyl guanidine (PHMG); and bis(aminoalkyl)alkylamine compounds such as bis(aminopropyl)dodecylamine.

Among them, non-halogenated quaternary ammonium salts such as didecylmethylpolyoxyethyleneammonium propionate and didecylmethylammonium carbonate; polyaminopropylguanidine hydrochloride (PHMG); and bis(aminoalkyl)alkylamine compounds such as bis(aminopropyl)dodecylamine are preferred.

The components (a), (b), and (c) used according to the present invention are the cationic polymers defined by Formulas 1 to 6:

the component (a): a polymer having a constitutional unit selected from formulas 1, 2, 3, 4 and salts thereof;

the component (b): a copolymer having a constitutional unit selected from formula 5 and salts thereof and a constitutional unit selected from formulas 1, 2, 3, 4 and salts thereof; and the component (c): a polymer having a constitutional unit selected from formula 6 and salts thereof, or a copolymer having a constitutional unit selected from formula 6 and salts thereof and a constitutional unit selected from formulas 1, 2, 3, 4 and salts thereof:

Formula 1

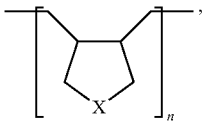

Formula 2

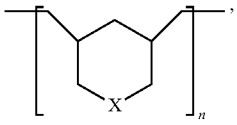

Formula 3

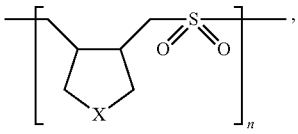

Formula 4

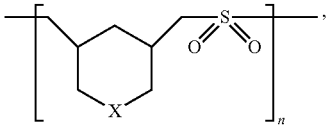

Formula 5

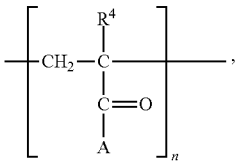

and

-continued

Formula 6

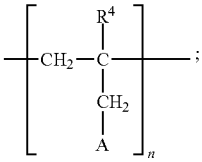

wherein X represents a group selected from:

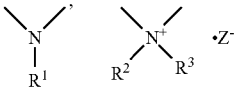

$R^1$ represents a hydrogen atom, an alkyl group having 1 to 3 carbon atoms or a hydroxyl group;

$R^2$ and $R^3$ independently represent an alkyl or hydroxyl alkyl group having 1 to 3 carbon atoms;

$Z^-$ represents a halogen ion, a sulfate ion, an alkyl sulfate ester ion having 1 to 3 carbon atoms, an aromatic sulfonate ion or a hydroxyl ion;

$R^4$ represents a hydrogen atom or an alkyl group having 1 to 3 carbon atoms;

A represents $—NH_2$, —OM, $—OR_5$ or $—NR_6R_7$;

M represents a monovalent cation;

$R^5$ represents an alkyl group having 1 to 24 carbon atoms;

$R^6$ and $R^7$ independently represent an alkyl or hydroxyl alkyl group having 1 to 3 carbon atoms; and n is an integer between 1 and 3,000.

These components do not impair the bactericidal effect and the antibacterial effect of the bacteria-eliminating active agent, but also render fabrics hydrophilicity, thereby assisting the function that the bacteria-eliminating active agents permeate the fabrics of clothing even when a washing machine is packed with a lot of laundry to wash together, namely fabrics of the clothing are many-layered, thereby the bactericidal effect and the antibacterial effect can thoroughly be imparted to the clothing.

Examples of the cationic polymers referred to as the component (a) typically include diallylamine hydrochloride polymers, diallylamine polymers, methylallylamine hydrochloride polymers, diallyldimethylammonium chloride polymers, diallylmethylethyl sulfate polymers, diallylamine hydrochloride-sulfur dioxide copolymers, diallylamine acetate-sulfur dioxide copolymers and the like.

Examples of the cationic polymers referred to as the component (b) typically include acrylamide-diallylamine hydrochloride copolymers, acrylamide-diallyldimethylammonium chloride copolymers and the like.

Examples of the cationic polymers referred to as the component (c) typically include allylamine hydrochloride polymers, allylamine polymers, allylamine hydrochloride-diallylamine hydrochloride copolymers, allylamine acetate-diallylamine acetate copolymers and the like.

The molecular weights of the cationic polymers used according to the present invention are preferably from 500 to 300,000, more preferably from 800 to 200,000 in a weight-average molecular weight in terms of polyethylene glycol as determined by gel permeation chromatography (GPC).

The surfactants used according to the present invention include such anionic surfactants, cationic surfactants, nonionic surfactants, and amphoteric surfactants as described in "Chemistry and Application of Surfactants" Manabu Seno (auth.), The Japan Chemical Society (co.), Jan. 30, 1995 (pub.); "Surfactants—Physical properties and Applications and Chemical ecology—" Fumio Kitahara, Yasukatsu Tamai, Shigeo Hayano and Ichiro Hara (ed.), Kodansha Ltd., Nov. 1, 1994 (pub.); and "Basic knowledge of Cleaning", Kenji Oh and Kazuhisa Yagi (auth.), Sangyou tosho Ltd., Heisei 11 March 31 (pub.). Among them it is preferably selected from the cationic surfactants, nonionic surfactants, and amphoteric surfactants.

The content of these surfactants can be appropriately determined in view of detergency, foaming property, stability and the like.

Other components used in a liquid detergent can be optionally contained, if necessary, and they include publically known water-soluble solvents, alkali agents, metal scavengers, anti-recontamination materials, antioxidants, rust inhibitors, preservatives and the like.

The water-soluble solvents include, for example, monohydric alcohols having 1 to 5 carbon atoms such as ethanol, dihydric alcohols having 2 to 12 carbon atoms such as propylene glycol, and polyalkylene glycol alkyl ethers such as diethylene glycol monoethylether.

The alkali agents include, for example, alkanolamines such as monoethanolamine

The metal scavengers include, for example, amino carboxylic acid-based ethylene diamine tetraacetic acid and salts thereof, hydroxyethylethylenediamine triacetic acid and salts thereof, hydroxyethylimino diacetic acid and salts thereof, diethylene triamino pentaacetic acid and salts thereof, triethylenetetramine hexa acetic acid and salts thereof, citric acid-based citric acid and salts thereof, phosphonic acid-based amino trimethylene phosphonic acid and salts thereof, ethylenediamine tetramethylene phosphonic acid and salts thereof, hydroxyethane diphosphonic acid and salts thereof, amino acid-based glutamic acid diacetic acid and salts thereof, methyl glycine diacetic acid and salts thereof and the like.

The anti-recontamination materials include, for example, polyacrylic acids, polymaleic acids, polyvinyl pyrrolidones, polyethylene glycols having an average molecular weight of 5,000 or higher, and the like.

The antioxidants include, for example, butyl hydroxy toluene, sodium sulfite, sodium bisulfite and the like.

The preservatives include, for example, Proxel XL2 (product name) and Proxel BDN (product name), both of which are manufactured by Lonza Inc., and the like.

The colorants/coloring agents include, for example, ordinary coloring matters and pigments such as Acid Red No. 138, Acid Yellow No. 203, Acid Blue No. 9, Blue No. 1, Blue No. 205, Green No. 3, in the product names, and the like.

According to the present invention, perfume(s) may also be contained solely or in combination of two or more perfume ingredients at a specific ratio thereof. The perfume ingredients include, for example, such as described in "Chemistry on Perfume" Ryoichi Akahoshi (auth.), Japan Chemistry (ed.) Industrial Chemistryl series, Sep. 16, 1983 (pub.) and "Synthetic Fragrances Chemistry and Knowledge on Product" (Motoichi Indo (auth.), The Chemical Daily Co. Ltd., Mar. 6, 1996 (pub.)), and the like. Specifically, they include hydrocarbon-based perfumes, alcohol-based perfumes, ether-based perfumes, aldehyde-based perfumes, ketone-based perfumes, ester-based perfumes, lactone-based perfumes, cyclic ketone-based perfumes, nitrogen-containing perfumes and the like.

In liquid laundry detergent compositions for clothing according to the present invention, the content of the bacteria-eliminating active agents is usually in the range of 0.1% to 20% by weight in terms of a concentration of active ingredients, the content of the at least one cationic polymer selected from the components (a), (b) and (c) is usually in the range of 0.1% to 20% by weight in a concentration of the active ingredient, and the content of the surfactants is usually not less than 5% and not more than 90% by weight in a concentration of the active ingredient. In the case of not more than 0.1% by weight of the antibacterially active cationic agent, the exhibition of the bactericidal effect and the antibacterial effect may not be expected. In the case of more than 20% by weight thereof, it may be difficult to maintain the detersive property and the low cost. In the case of not more than 0.1% by weight of the cationic polymers, it may be difficult to impart permeability to the antibacterially active cationic agent. In the case of not less than 20% by weight thereof, it may be difficult to maintain the detersive property and the low cost. In the case of not more than 5% by weight of the surfactants, it may be inferior in the detersive property, in the case of more than 90% by weight thereof, it may be difficult to maintain the balance between the bacteria-eliminating active agents and the cationic polymers.

EXAMPLE

The present invention will now be described in more detail by way of examples, but the present invention should not be construed as limiting to these examples.

The liquid laundry detergent compositions for clothing are shown in Table 1.

TABLE 1

| | Liquid laundry detergent composition for clothing | | | | | |
|---|---|---|---|---|---|---|
| | 1 | 2 | 3 | 4 | 5 | 6 |
| PHMG powders | 6 | 6 | 6 | | 6 | |
| Lonzabac 12 | | | | 6 | | |
| MERQUAT100 weght average molecular weight 150,000 | 21 | | | | | |
| PAS-J-81 weight average molecular weight 180,000 | | 21 | | | | 42 |
| PAA-HCL-10L weight average molecular weight 150,000 | | | 15 | 15 | | |
| Softanol 150 | 45 | 45 | 45 | | 45 | 45 |
| Nikkor BT20 | | | | 45 | | |
| Purified water | 28 | 28 | 34 | 34 | 49 | 13 |
| Total | 100 | 100 | 100 | 100 | 100 | 100 |

Concentration of Active Ingredients:
Lonzabac12: 100%
MERQUAT100: 40%
PAS-J-81: 25%
PAA-HCL-10L: 40%
Softanol 150: 30%
Nikkor BT20: 100%

Example 1

6 g of polyaminopropylguanidine hydrochloride (PHMG powders) as the bacteria-eliminating active agent, 21 g of diallyldimethylammonium chloride polymer as the component (a) (manufactured by Lubrizol Corp., MERQUAT100), and 45 g of the surfactant (manufactured by Nippon Shokubai Co., Ltd., Softanol 150) were added to water. The mixture was completely dissolved to obtain 100 g of a liquid laundry detergent composition for clothing 1. 3,000 ml of water was added to 1 g of the composition 1 to prepare a diluted solution which was diluted by 3,000 times. Bactericidal and antibacterial effects of this diluted solution were evaluated using the following method. The evaluation results are shown in Table 2.

[1] Method of Evaluating Bactericidal Effects (Evaluation of Bactericidal Effects on *Staphylococcus aureus*)

(1) Preparation of a Bacteria-containing Liquid

*Staphylococcus aureus* (NBRC 12732) was cultured in a SCD agar plate medium at a temperature of 36° C. to 37° C. for 24 hours. A loopful of the obtained culture was placed in a phosphate-buffered saline containing horse serum as an interfering substance, and the number of bacteria therein was adjusted to an order of $10^9$ cfm/ml to obtain a bacteria-containing liquid sample.

(2) Making of Spindles

Lap clothes (cotton shirting No. 3) which had been boiled and dried, were evenly wound on the outside of a glass vial (AS ONE Corp., MIGHTY VIAL No. 7) twelve times and finally fixed with plastic tape. The obtained spindles were sterilized in an autoclave and then subjected to the following test.

(3) Preparation of a Test Sample

Into a sterilized jar with the volume of 400 ml, charged was 250 ml of the diluted solution, as mentioned above, which was prepared by 3,000 times-diluting each of the compositions shown in Table 1.

Inoculation Test of Bacterial-containing Liquids

Inoculation of Bacteria-containing Liquids into Test Clothes

10 μL of the bacterial-containing liquid sample as prepared above was inoculated into three test clothes, and then they were placed in a moisture-controlled box (at 37° C.) for 40 minutes, in which moisture had been previously controlled. After taking them out, they were inserted into the spindle in such a way that they were inserted between the third winding cloth and the forth winding cloth from the outside thereof.

Simulated Washing

The spindle into which the test clothes were inserted, was put into the sterilized jar containing 250 ml of the diluted solution as prepared above, and the lid thereof was firmly closed. It was subjected to the simulated washing for 10 minutes using the transverse direction rotor at 40 rpm.

Neutralization and Extraction

The test clothes were taken out from the spindle immediately after the simulated washing was done for 10 minutes, and then each test cloth was put in 10 ml of SCDLP liquid medium (in a test tube), and it was stirred sufficiently on Vortex to obtain a suspension.

Measurement of the Number of Living Bacteria

After stirring, 1 ml of the suspension was taken out and were subjected to the pour plate technique. 10-fold serial dilutions thereof were made with a diluent (phosphate buffer), and were cultured on SCDLP agar medium plates. After the plate was kept at 37° C.±1° C. for 4 to 5 days, the number of colonies on the plates (cfu/ml) was counted.

Control Test

The inoculation tests of the bacterial containing liquid and the simulated washing were performed for a positive control and a negative control. As the positive control, there was used a standard specification conditions of "Room dry-Top" from the Lion, Inc., or "Attack reset power" from Kao Corp. which are the powder bactericidal laundry detergents with a disinfection mark respectively. As the negative control, 0.05% Tween80 was used.

Calculation Formula

Bactericidal activity value was calculated by the following formula (i).

$$\text{Bactericidal activity value}=(a-b)/a\times 100 \quad \text{(i)}$$

a=the number of living bacteria in the negative control test b=the number of living bacteria in the test washing liquid Validation Criteria of Bactericidal Effects When the number of living bacteria in the test washing liquid was less than that in "Room dry-Top" from Lion, Inc., or "Attack reset power" from Kao Corp. as positive control, it was decided that bactericidal effects were exhibited.

[2] Method of Evaluating Antibacterial Effects on *Staphylococcus aureus*

(1) Making of a Spindle

A piece of lap cloth (cotton shirting No. 3) which had been boiled and dried, was evenly wound on the outside of a glass vial (AS ONE Corp., MIGHTY VIAL No.7) twelve times and finally fixed with plastic tape. The obtained spindle was sterilized in an autoclave and then subjected to the following test.

(2) Preparation of a Test Sample

Into a sterilized jar with the volume of 400 ml, charged was 250 ml of the diluted solution, as mentioned above, which was prepared by 3,000 times-diluting each of the compositions shown in Table 1.

Insertion of Test Clothes

Three test clothes (0.4 g, respectively) were inserted into the spindle in such a way that they were inserted between the third winding cloth and the forth winding cloth from the outside thereof.

Simulated Washing

The spindle into which the test clothes were inserted, was put into the sterilized jar containing 250 ml of the test sample as prepared above, and the lid thereof was firmly closed. It was subjected to the simulated washing for 10 minutes using the transverse direction rotor at 40 rpm.

The test clothes were taken out and put into a sterilized bottle. Then, they were sufficiently dried in a drier for 12 hours at 50° C.

(3) Inoculation Test of Bacterial-containing Liquids

A quantitative method (according to the standardized test method) for antibacterial test of fiber products (JIS L1902-2002). Namely, using *Staphylococcus aureus* (NBRC 12732) cultured according to JIS L1902 and a 20 times-diluted nutrient medium, a bacteria-containing liquid was made in such a manner that the number of bacteria therein was 1 ±0.3 ×$10^5$cfm/ml. The bacterial containing liquid was uniformly inoculated on the test clothes which were subjected to simulated washing and drying as mentioned above, and the test clothes were cultured for 18 hours in a thermostatic bath at 37 ° C. Then, the bacteria were extracted from each of the test clothes using a saline for washing out, and 10-fold serial dilutions thereof was made and subjected to the pour culture on SCDLP agar medium by putting the pour plates in a thermostatic bath at 37° C. for one or 2 days. And then, the number of colonies on the plates was counted to determine the number of living bacteria.

Untreated clothes were subjected to the same procedures as the test clothes to determine the number of living bacteria. Antibacterial activity values were calculated from these measurements by the following equation (ii).

$$\text{Antibacterial activity values}=\text{Log (the number of bacteria in the untreated cloth/the number of bacteria in the test cloth)} \quad \text{(ii)}$$

Validation Criteria of Antibacterial Effects

Antibacterial effects were evaluated according to the following criteria.

[Evaluation Criteria]

The symbol "○" represents that an antibacterial activity value is 2 or more.

The symbol "Δ" represents that an antibacterial activity value is not less than 1.0 and less than 2.0.

The symbol "×" represents that an antibacterial activity value is less than 1.0

Example 2

6 g of polyaminopropylguanidine hydrochloride (PHMG powders) as the bacteria-eliminating active agent, 21 g of acrylamide-diallyldimethylammonium chloride copolymer (manufactured by Nittobo Medical Co., PAS-J-81) as the component (b), and 45 g of a surfactant (manufactured by Nippon Shokubai Co., Ltd., Softanol 150) were added to water. The mixture was completely dissolved to obtain 100 g of a liquid laundry detergent composition for clothing 2.

3,000 ml of water was added to 1 g of the composition 2 to prepare a diluted solution which was diluted by 3,000 times.

The bactericidal and antibacterial effects of this diluted solution were evaluated by the same procedures as those in Example 1.

Example 3

6 g of polyaminopropylguanidine hydrochloride (PHMG powders) as the bacteria-eliminating active agent, 15 g of allylamine hydrochloride polymer (manufactured by Nittobo Medical Co., PAA-HCL-10L) as the component (c), and 45 g of a surfactant (manufactured by Nippon Shokubai Co., Ltd., Softanol 150) were added to water. The mixture was completely dissolved to obtain 100 g of a liquid laundry detergent composition for clothing 3.

3,000 ml of water was added to 1 g of the composition 3 to prepare a diluted solution which was diluted by 3,000 times.

The bactericidal and antibacterial effects of this diluted solution were evaluated by the same procedures as those in Example 1.

Example 4

6 g of bis(aminopropyl)dodecylamine (manufactured by Lonza Inc., Lonzabac12) as the bacteria-eliminating active agent, 15 g of allylamine hydrochloride polymer (manufactured by Nittobo Medical Co., PAA-HCL-10L) as the component (c), and 45 g of a surfactant (manufactured by Nikko Chemicals corp., Ltd., Nikkol BT20) were added to water. The mixture was completely dissolved to obtain 100 g of a liquid laundry detergent composition for clothing 4.

3,000 ml of water was added to 1 g of the composition 4 to prepare a diluted solution which was diluted by 3,000 times.

The bactericidal and antibacterial effects of this diluted solution were evaluated by the same procedures as those in Example 1.

Comparative Example 1

6 g of polyaminopropyl guanidine hydrochloride (PHMG powders) as the bacteria-eliminating active agent and 45 g of a surfactant (manufactured by Nippon Shokubai Co., Ltd., Softanol 150) were added to water. The mixture was completely dissolved to obtain 100 g of a liquid laundry detergent composition for clothing 5.

3,000 ml of water was added to 1 g of the composition 5 to prepare a diluted solution which was diluted by 3,000 times.

The bactericidal and antibacterial effects of this diluted solution were evaluated by the same procedures as those in Example 1.

Comparative Example 2

42 g of acrylamide-diallyldimethylammonium chloride copolymer (manufactured by Nittobo Medical Co., PAS-J-81) as the component (b) and 42 g of a surfactant (manufactured by Nippon Shokubai Co., Ltd., Softanol 150) were added to water. The mixture was completely dissolved to obtain 100 g of a liquid laundry detergent composition for clothing 6.

3,000 ml of water was added to 1 g of the composition 6 to prepare a diluted solution which was diluted by 3,000 times.

The bactericidal and antibacterial effects of this diluted solution were evaluated by the same procedures as those in Example 1.

The evaluation results are shown in Table 2.

TABLE 2

| Evaluation | Example | | | | Comparative Example | |
|---|---|---|---|---|---|---|
| items | 1 | 2 | 3 | 4 | 1 | 2 |
| Bactericidal effect | exhibited | exhibited | exhibited | exhibited | not exhibited | not exhibited |
| Antibacterial effect | ○ | ○ | ○ | ○ | Δ | X |

INDUSTRIAL APPLICABILITY

The liquid laundry detergent composition for clothing according to the present invention is very excellent in that it can sufficiently exhibit bactericidal effects and antibacterial effect in drying after washing, when many clothes coexist during washing, namely even when a washing machine is packed with a lot of laundry to wash together.

Accordingly, a liquid laundry detergent composition for clothing of the present invention can be suitably used as a laundry detergent composition for textiles such as clothes.

The invention claimed is:

1. A liquid laundry detergent composition for clothing consisting of:

a bacteria-eliminating active agent, at least one cationic polymer selected from components (a), (b) and (c), a surfactant, and optionally one or more water-soluble solvents, alkali agents, metal scavengers, anti-recontamination materials, antioxidants, rust inhibitors, preservatives, colorants, coloring agents, and perfumes;

wherein the component (a) is a polymer having a constitutional unit selected from formulas 1, 2, 3, 4 and salts thereof;

the component (b) is a copolymer having a constitutional unit selected from formula 5 and salts thereof and a constitutional unit selected from formulas 1, 2, 3, 4 and salts thereof; and the component (c) is a polymer having a constitutional unit selected from formula 6 and salts thereof, or a copolymer having a constitutional unit selected from formula 6 and salts thereof and a constitutional unit selected from formulas 1, 2, 3, 4 and salts thereof:

Formula 1

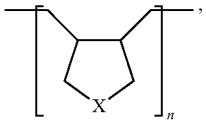

Formula 2

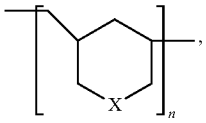

Formula 3

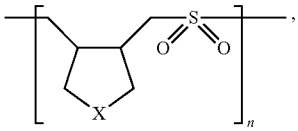

Formula 4

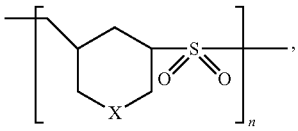

Formula 5

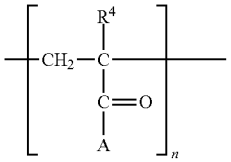

and

Formula 6

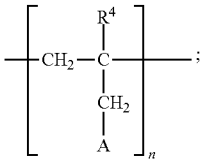

wherein X represents

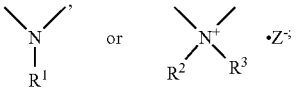

$R^1$ represents a hydrogen atom, an alkyl group having 1 to 3 carbon atoms or a hydroxyl group;

$R^2$ and $R^3$ independently represent an alkyl or hydroxyalkyl group having 1 to 3 carbon atoms;

$Z^-$ represents a halogen ion, a sulfate ion, an alkyl sulfate ion having 1 to 3 carbon atoms, an aromatic sulfonate ion or a hydroxyl ion;

$R^4$ represents a hydrogen atom or an alkyl group having 1 to 3 carbon atoms;

A represents —$NH_2$, —OM, —$OR^5$ or —$NR^6R^7$;

M represents a monovalent cation;

$R^5$ represents an alkyl group having 1 to 24 carbon atoms;

$R^6$ and $R^7$ independently represent an alkyl or hydroxyalkyl group having 1 to 3 carbon atoms; and n is an integer between 1 and 3,000; and wherein the bacteria-eliminating active agent is at least one selected from the group consisting of a guanidine compound, an imidazolium salt derivative, and a bis (aminoalkyl)alkylamine compound.

2. The liquid laundry detergent composition for clothing according to claim 1, wherein the bacteria-eliminating active agent is at least one selected from the group consisting of:

a polyaminopropyl guanidine compound; an imidazolium salt derivative selected from the group consisting of 1,10-di(3-decyl-2-methylimidazolium)decane dichloride, 1,10-di(3-decyl-2-methylimidazolium)decane dibromide, 1,12-di(3-decyl-2-methylimidazolium)dodecane dichloride, 1,12-di(3-octyl-2-methylimidazolium)dodecane dichloride, and 1,10-di(3-decyl-2-methylimidazolium)decane dichloride; and bis (aminopropyl)dodecylamine.

3. The liquid laundry detergent composition for clothing according to claim 1, wherein the bacteria-eliminating active agent includes at least one member selected from the group consisting of:

a polyaminopropyl guanidine hydrochloride and bis (aminopropyl)dodecylamine.

4. The liquid laundry detergent composition for clothing according to claim 1, comprising:

the bacteria-eliminating active agent in an amount between 0.1% by weight and 20% by weight, the at least one cationic polymer selected from the components (a), (b) and (c) in an amount between 0.1% by weight and 20% by weight, and the surfactant in an amount between 5% by weight and 90% by weight.

* * * * *